US006478546B2

(12) United States Patent
Centers

(10) Patent No.: US 6,478,546 B2
(45) Date of Patent: Nov. 12, 2002

(54) MULTISTAGE BLOWDOWN VALVE FOR A COMPRESSOR SYSTEM

(75) Inventor: Steven D. Centers, Daphne, AL (US)

(73) Assignee: Coltec Industries Inc., Charlotte, SC (US)

( * ) Notice: Subject to any disclaimer, the term of this patent is extended or adjusted under 35 U.S.C. 154(b) by 0 days.

(21) Appl. No.: 10/022,920

(22) Filed: Dec. 18, 2001

(65) Prior Publication Data

US 2002/0051708 A1 May 2, 2002

Related U.S. Application Data

(63) Continuation of application No. 09/892,587, filed on Jun. 27, 2001, now Pat. No. 6,371,731, which is a continuation of application No. 09/422,284, filed on Oct. 21, 1999, now Pat. No. 6,283,716, which is a continuation-in-part of application No. 09/179,523, filed on Oct. 27, 1998, now Pat. No. 6,102,665.

(60) Provisional application No. 60/066,008, filed on Oct. 28, 1997.

(51) Int. Cl.[7] ..... F04B 49/00

(52) U.S. Cl. ..... 417/18

(58) Field of Search ..... 417/283, 18, 307, 417/308; 137/30.19, 25.34, 3, 889.3, 115.16, 115.21; 91/418, 503, 378, 437; 123/506; 251/324, 44

(56) References Cited

U.S. PATENT DOCUMENTS 3,260,444 A 7/1966 Williams et al.
3,756,753 A 9/1973 Persson et al.
3,927,708 A * 12/1975 Hulme ..... 152/415
3,936,239 A 2/1976 Shaw
4,076,468 A 2/1978 Persson et al.
4,084,618 A * 4/1978 Gurries ..... 137/625.48
4,105,064 A * 8/1978 Del Toro et al. ..... 165/233
4,155,535 A * 5/1979 Seamone ..... 137/625.3
4,339,233 A * 7/1982 Krueger ..... 137/533.11
4,646,785 A * 3/1987 Ruedle et al. ..... 137/625.64
4,678,406 A 7/1987 Pillis et al.
5,044,894 A 9/1991 Field et al.
5,163,478 A * 11/1992 de Fries ..... 137/625.25
5,335,696 A * 8/1994 McKenzie ..... 137/863
5,655,379 A * 8/1997 Jaster et al. ..... 137/392
5,713,724 A * 2/1998 Centers et al. ..... 417/279
5,738,497 A 4/1998 Hensley
5,833,925 A * 11/1998 Shu et al. ..... 251/129.17
5,860,801 A 1/1999 Timuska
6,053,421 A * 4/2000 Chockley ..... 123/446
6,102,665 A * 8/2000 Centers et al. ..... 417/17
6,283,716 B1 * 9/2001 Centers ..... 417/18

* cited by examiner

*Primary Examiner*—Teresa Walberg
*Assistant Examiner*—Daniel Robinson
(74) *Attorney, Agent, or Firm*—John M. Harrington; Kilpatrick Stockton LLP

(57) ABSTRACT

A multi-stage blowdown valve is provided that uses a single control signal to simultaneously decompress the interstage and the second stage in a compressor system. The valve uses a series of sliding spools located linearly within a single bore to either prevent or allow fluid communication between two isolated passageways each having an inlet port and a discharge port. The valve, when used as a two stage blowdown valve in a multi-stage compressor system, can prevent compressor failure from occurring by ensuring that both the interstage and the second stages are decompressed. not only the interstage.

15 Claims, 5 Drawing Sheets

MULTISTAGE BLOWDOWN VALVE FOR A COMPRESSOR SYSTEM

RELATED APPLICATIONS

This application is a continuation of commonly owned U.S. patent application Ser. No. 09/892,587, filed Jun. 27, 2001, of Centers now U.S. Pat. No. 6,371,731 B2, issued Mar. 16, 2002, which is a continuation of commonly owned U.S. patent application Ser. No. 09/422,284, filed Oct. 21, 1999, of Centers now U.S. Pat. No. 6,283,716 B1, issued Sep. 4, 2001, which is a continuation-in-part of commonly owned U.S. patent application Ser. No. 09/179,523, filed Oct. 27, 1998, of Centers et al. now U.S. Pat. No. 6,102,665, issued Aug. 15, 2000, which is a continuation-in-part of commonly owned U.S. Provisional Patent Application Ser. No. 60/066,008, filed Oct. 28, 1997, of Centers et al., the disclosures of which are herein incorporated by reference.

FIELD OF THE INVENTION

The present application relates generally to a control valve. More specifically, it relates to a control valve used with compressors. Most specifically, it relates to a blowdown valve used with one or more oil free two stage screw compressors.

BACKGROUND OF THE INVENTION

Power consumption for a two stage dry (oil free) screw compressor is significantly reduced if the interstage and the second stage are both decompressed when the compressor is running unloaded. The problem with decompressing both stages. however, is that if the second stage blowdown valve malfunctions, the interstage blowdown valve will decompress the interstage and leave a large differential pressure on the second stage. This large differential pressure will raise the temperature of the second stage, possibly leading to compressor failure.

Previous compressors avoided the above problem by only unloading pressure from the second stage and not from both stages. The disadvantage, however, of unloading pressure only from the second stage when running the compressor unloaded is that the compressor's power consumption is greater than if both stages are unloaded.

Previous valve mechanisms for compressors have not adequately addressed the problem of simultaneously decompressing two isolated stages. U.S. Pat. No. 3,260,444 to Williams discloses valve mechanisms 104 and 110 which are controlled by the same control line 158 and operate in a similar manner. With valve 104, for example, control line 158 can move piston 130 to control whether pipe 106 is in communication with pipe 113 or pipe 102. The disadvantage with using these valves as blowdown valves for a two stage compressor is that if one valve should malfunction, the other valve may continue to function, possibly leading to compressor failure.

What is desired, therefore, is a reliable mechanism for a two stage dry screw compressor to decompress the interstage blowdown valve when the second stage blowdown valve is activated.

SUMMARY OF THE INVENTION

Accordingly, it is a primary object of the present invention to provide a blowdown valve for two stages of a multi-stage compressor such that the valve reliably decompresses the interstage when the second stage is decompressed.

The object of the invention is achieved by a blowdown valve that uses a single control signal to simultaneously decompress the interstage when the second stage is decompressed. The valve uses a series of sliding spools located linearly within a single bore to either prevent or allow fluid communication between two isolated passageways each having an inlet port and a discharge port. The valve can be reliably used as a two stage blowdown valve in a multi-stage compressor system.

DETAILED DESCRIPTION OF THE INVENTION

Figure 1A:
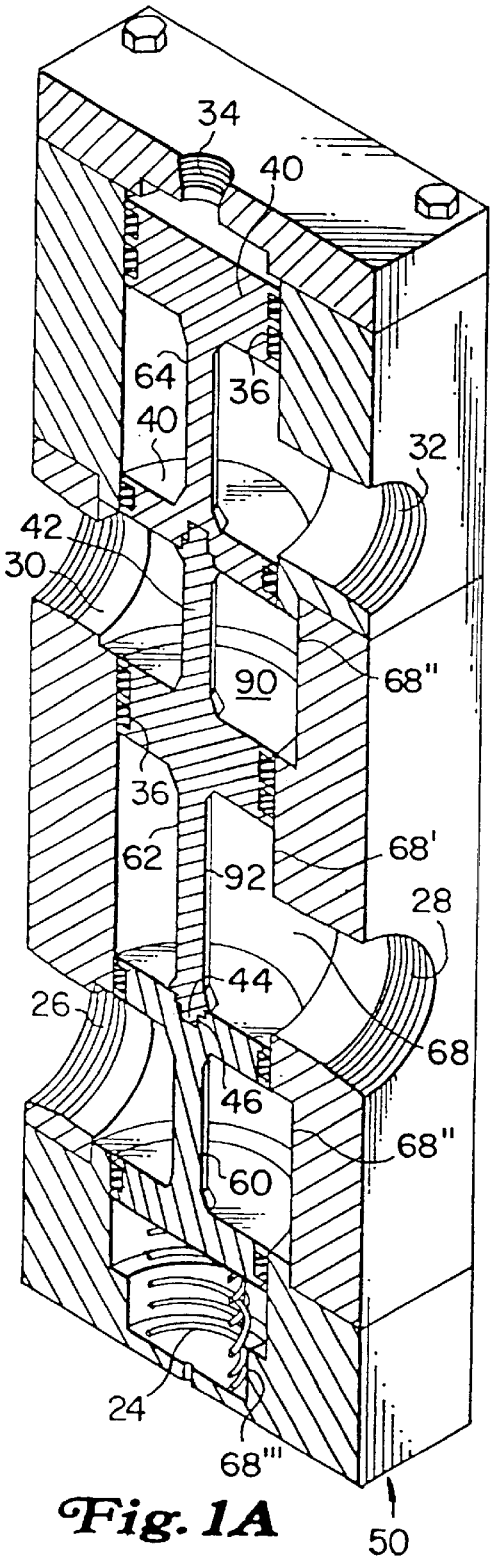
FIGS. 1A and 1B each show an isometric cross-sectional view of the multistage blowdown valve of the present invention wherein the valve is in a closed position and an open position, respectively.
Figure 1B:
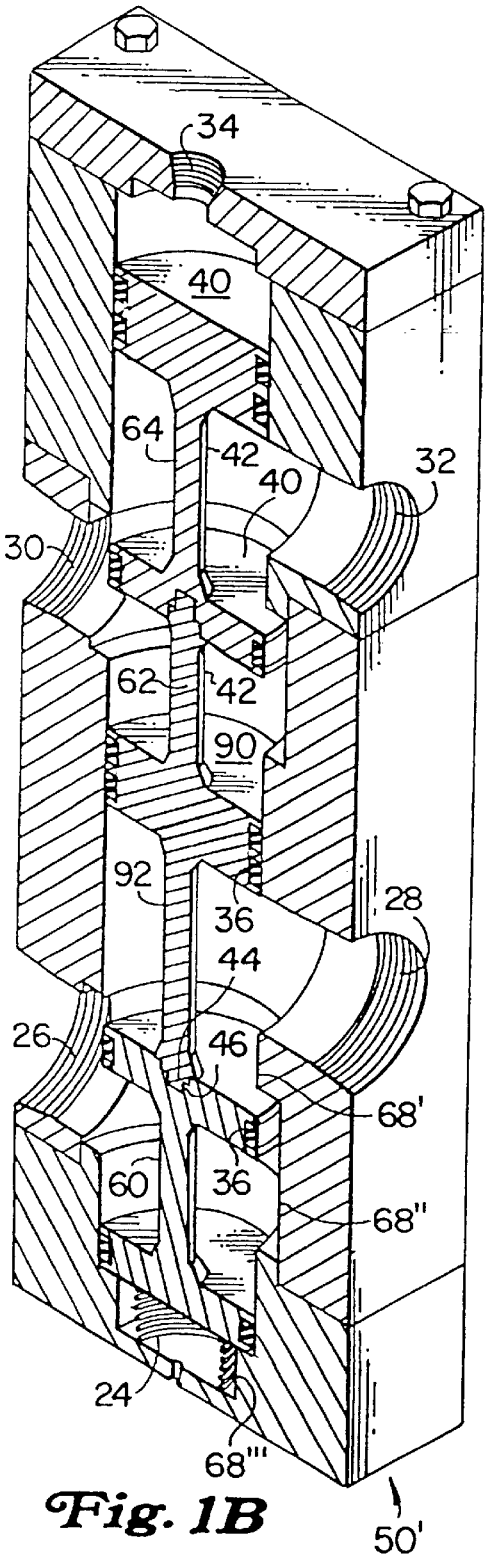

FIGS. 1A and 1B show the preferred embodiment for the multistage blowdown valve 50 of the present invention. Referring to these figures, the multistage blowdown valve 50 has two inlet ports, 26, 30 and two discharge ports 28, 32. When the valve 50 is in a closed position as shown in FIG. 1A, all ports 26, 28, 30 and 32 are fluidly isolated from one another. When the valve 50' is in an open position as shown in FIG. 1B, inlet port 26 is in fluid communication only with discharge port 28 and inlet port 30 is in fluid communication only with discharge port 32. It should be apparent that the valve 50 could operate in a reverse direction with the inlet ports 26, 30 acting as discharge ports and discharge ports 28, 32 acting as inlet ports.

The multistage blowdown valve 50 has a main bore 68 that can have a single diameter, but preferably has three diameters 68', 68"and 68'". Larger diameter 68" facilitates a larger volume of fluid passage through the valve and also prolongs the life of the rings 36. Thus, for example, the life of ring 36 on spool 17 will be prolonged by avoiding repeated contact with the edges of inlet 26 as the spool reciprocates through the bore 14. The smaller diameter 68'" helps to center the spring 24 within the bore 68.

Within the bore 68 are a plurality of spools 60. 62. and 64 that linearly abut each other within the bore. Spools 60 and 64 each have a leg portion 42 bounded by two head portions 40. Spool 62 has one head portion 40 bounded by two leg portions 42. Adjacent spools are preferably coupled through the use of a mortise and a tenon. For example, each leg portion 42 of spool 62 can have a tenon 44 for fitting into a mortise 46 in a head portion of adjacent spools 60 and 64.

Each head portion 40 further preferably has one or more rubber rings 36 inserted into a corresponding annular groove in the head portion such that each spool has airtight contact within the bore 14 as the spools move within the bore. The preferred type of ring used for ring 36 on the spools 16–20 or 60, 62 and 64 are sometimes referred to as V-rings or U-rings which refer to the ability of the ring to fold when placed in a bore. The beneficial properties of the folding ring design include reduced sticking when the spools move in bore 14, reduced sliding forces which allow lower and repeatable control forces, improved sealing by the ring unfolding under pressure, and durability in that all of the desirable properties of the folding ring continue even after partial ring wear. The folding ring design also provides reliable operation when the spools move within the various diameters of the bore, for example, from diameter 14' to 14" or 68' to 68" and then back again.

The movement of spools 60, 62 and 64 is controlled through pneumatic pressure applied against the head 40 of spool 64 through control port 34. A spring 24 is located within the bore preferably at an opposite end of the control port 34 and extends laterally through the bore. The spring 24 abuts the head 40 from spool 60 to bias the valve to a closed position (see FIG. 1A). Furthermore, spring means, such as compression spring 24, counteracts the force of the control signal when the valve is in an open position (see FIG. 1B) and returns the blowdown valve to a closed position when the control signal is inactive. Alternatively, a tension spring and the control port could operate together at the same end of the bore, although those skilled in the art will realize that the control signal will operate in an inverse manner.

Figure 2A:
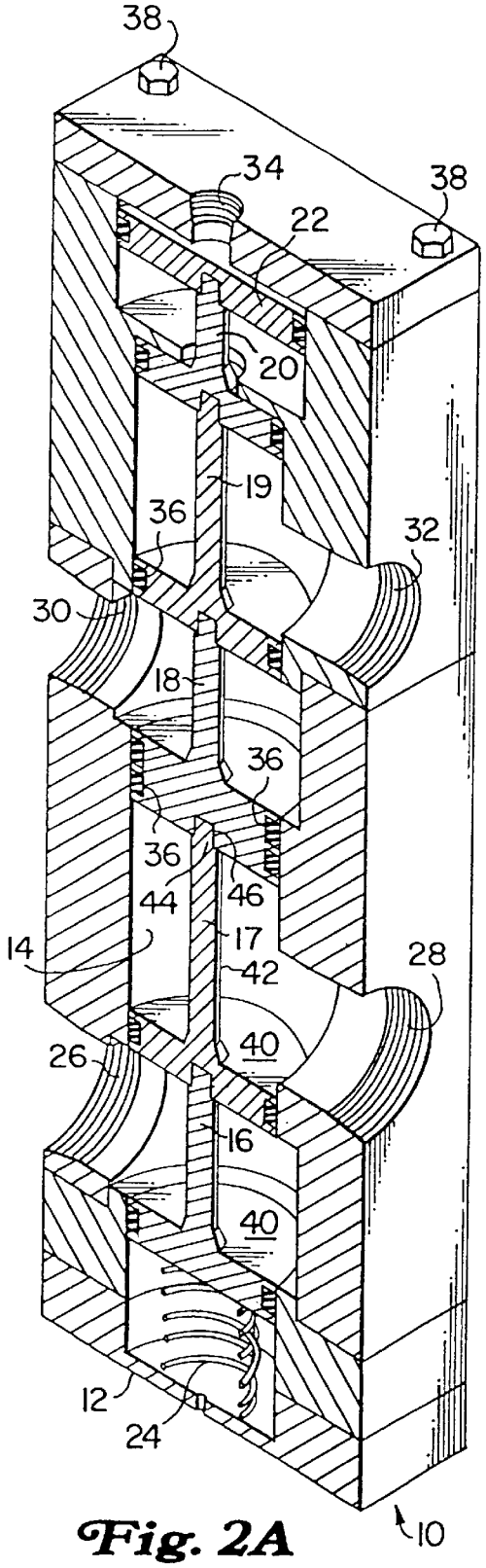
FIGS. 2A and 2B each show an isometric cross-sectional view of a second embodiment of the multistage blowdown valve of the present invention wherein the valve is in a closed position and an open position, respectively.
Figure 2B:
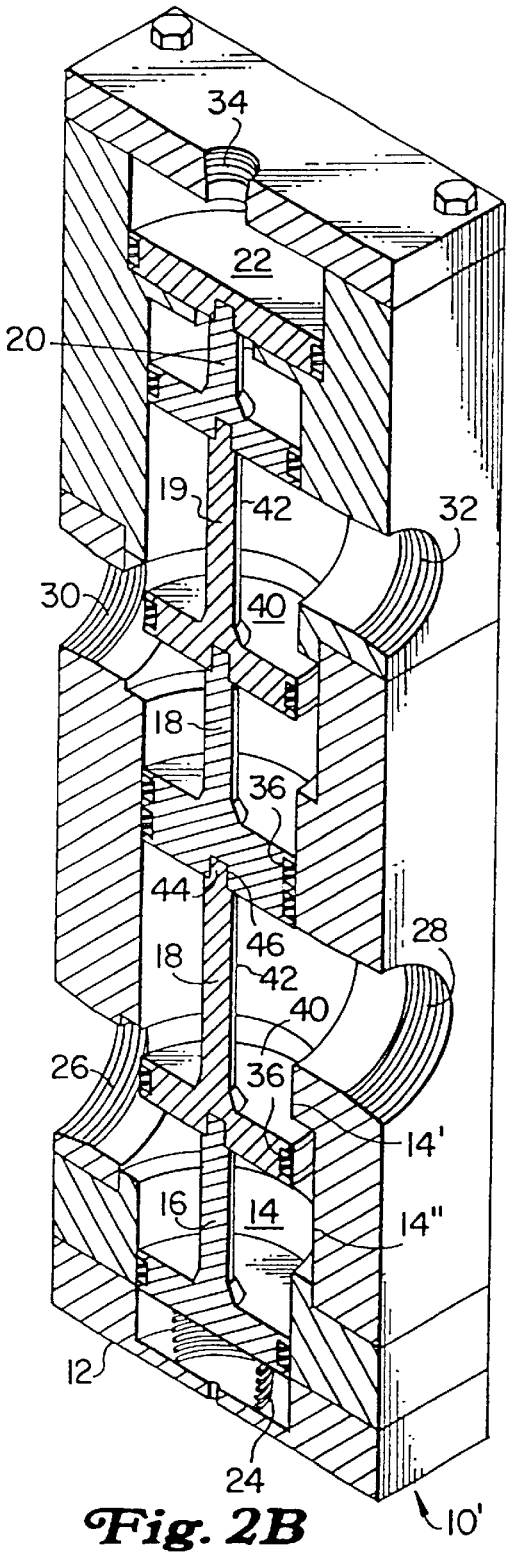
Figure 3A:
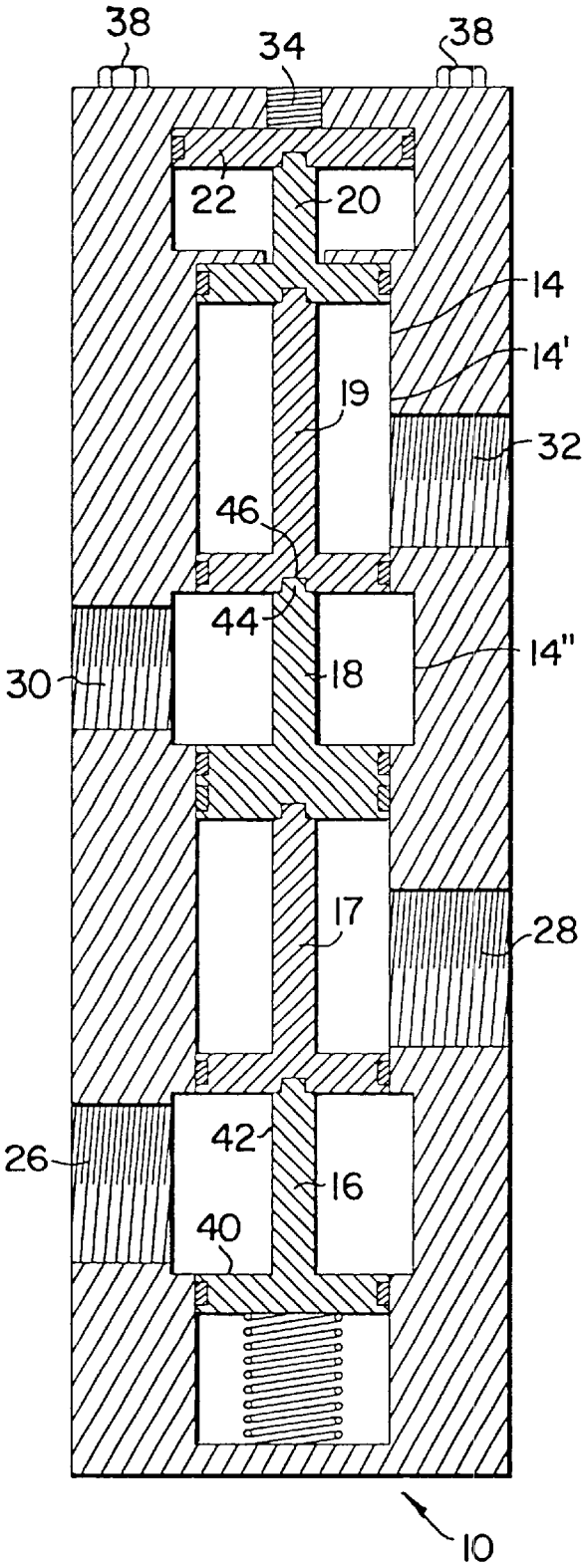
FIGS. 3A and 3B are front cross-sectional and side cross-sectional views, respectively, of the valve of FIG. 2A.
Figure 3B:
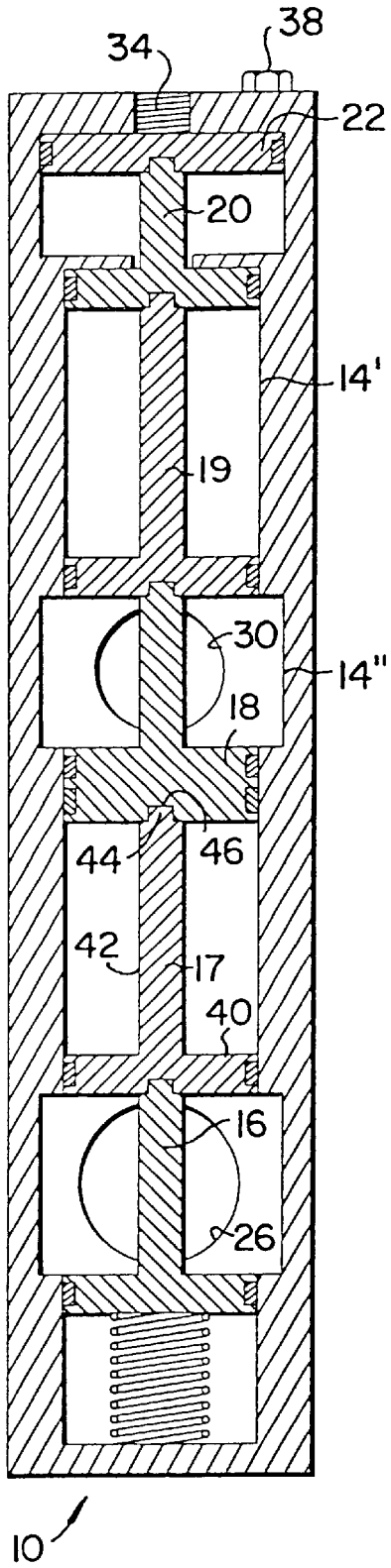

FIGS. 2A, 2B, 3A and 3B show another embodiment of the multistage blowdown valve 10 and 10' of the present invention. FIG. 2B shows the blowdown valve 10' in an open position and FIGS. 2A, 3A and 3B show the blowdown valve 10 in a closed position. The multistage blowdown valve 10 generally differs from multistage blowdown valve 50 in that it has a different configuration of spools 16–20 and does not have a smaller bore near the compression spring 24. Instead, the multistage blowdown valve 10 has a main bore 14 with two diameters 14' and 14".

Referring to FIGS. 2A, 2B, 3A and 3B, within bore 14 are a plurality of spools 16–20 that linearly abut each other within the bore. Each spool 16–20 has a leg portion 42 and a head portion 40. Adjacent spools are preferably coupled through the use of a mortise and a tenon. For example, each head portion 40 of each spool 16–20 can have a mortise 46 for fitedly receiving a tenon 44 on the leg portion 42 of the adjacent spool.

Although the present invention uses a plurality of spools within the bore, a single spool could also be used for the same function. However, a plurality of individual spools 16–20 or 60, 62 and 64 are preferably used because they create a better seal by reacting to both the control pressure and internal pressures produced from the inlet ports. However, it is more preferable to use the spools 60, 62 and 64 shown in FIGS. 1A and 1B because less linear deviations will occur during spool movement than with the configuration of spools 16–20 shown in FIGS. 2A and 2B.

It should be apparent to those skilled in the art that although the valve described herein is for a two-stage compressor, the valve can be adapted for compressors having three or more stages. To create a multi-stage blowdown valve, the valve described herein merely needs a longer bore, additional spools and extra inlet and discharge ports.

Figure 4:
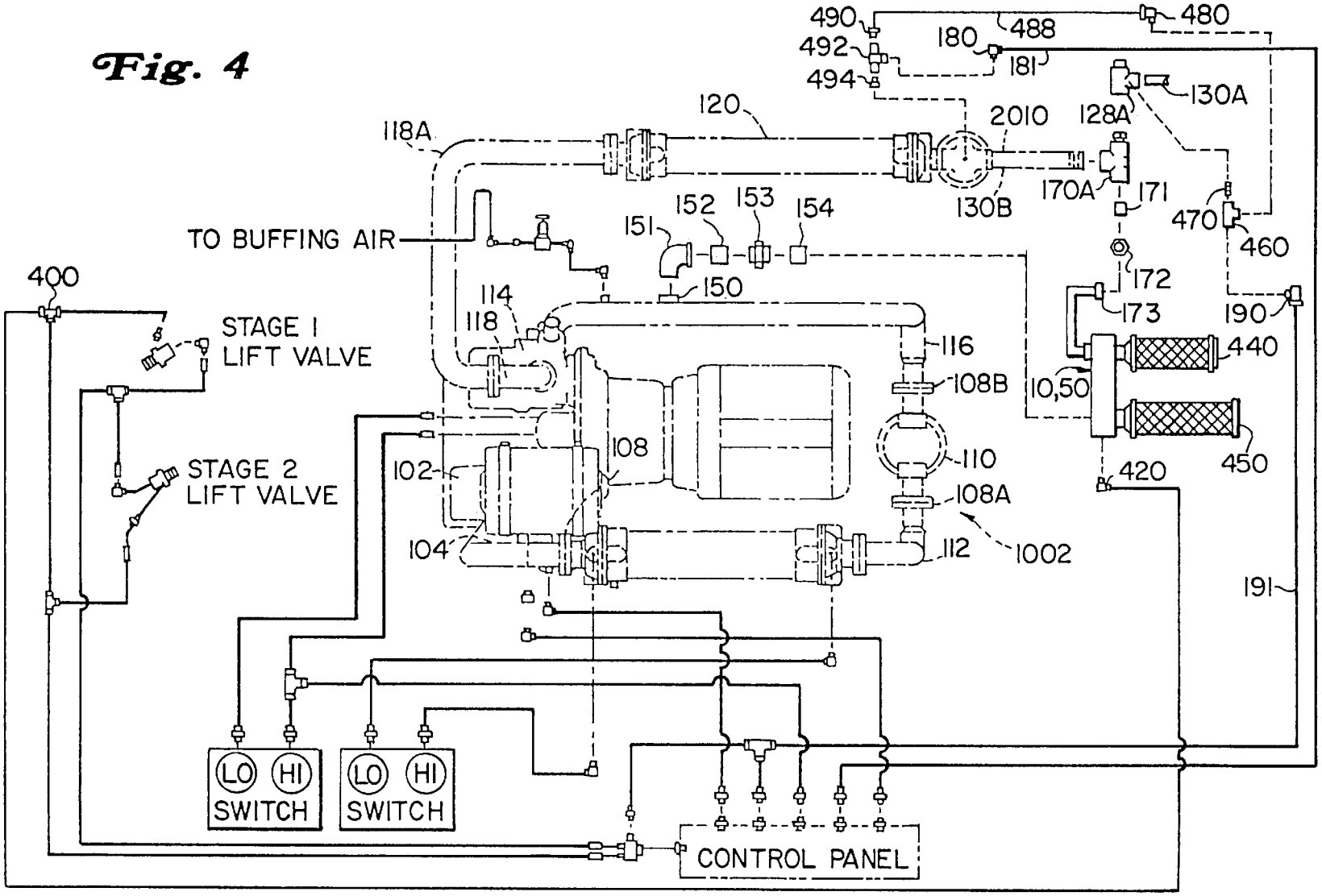
FIG. 4 is a diagram showing the multistage blowdown valve of FIGS. 1A and 1B used with a compressor system.
Figure 5:
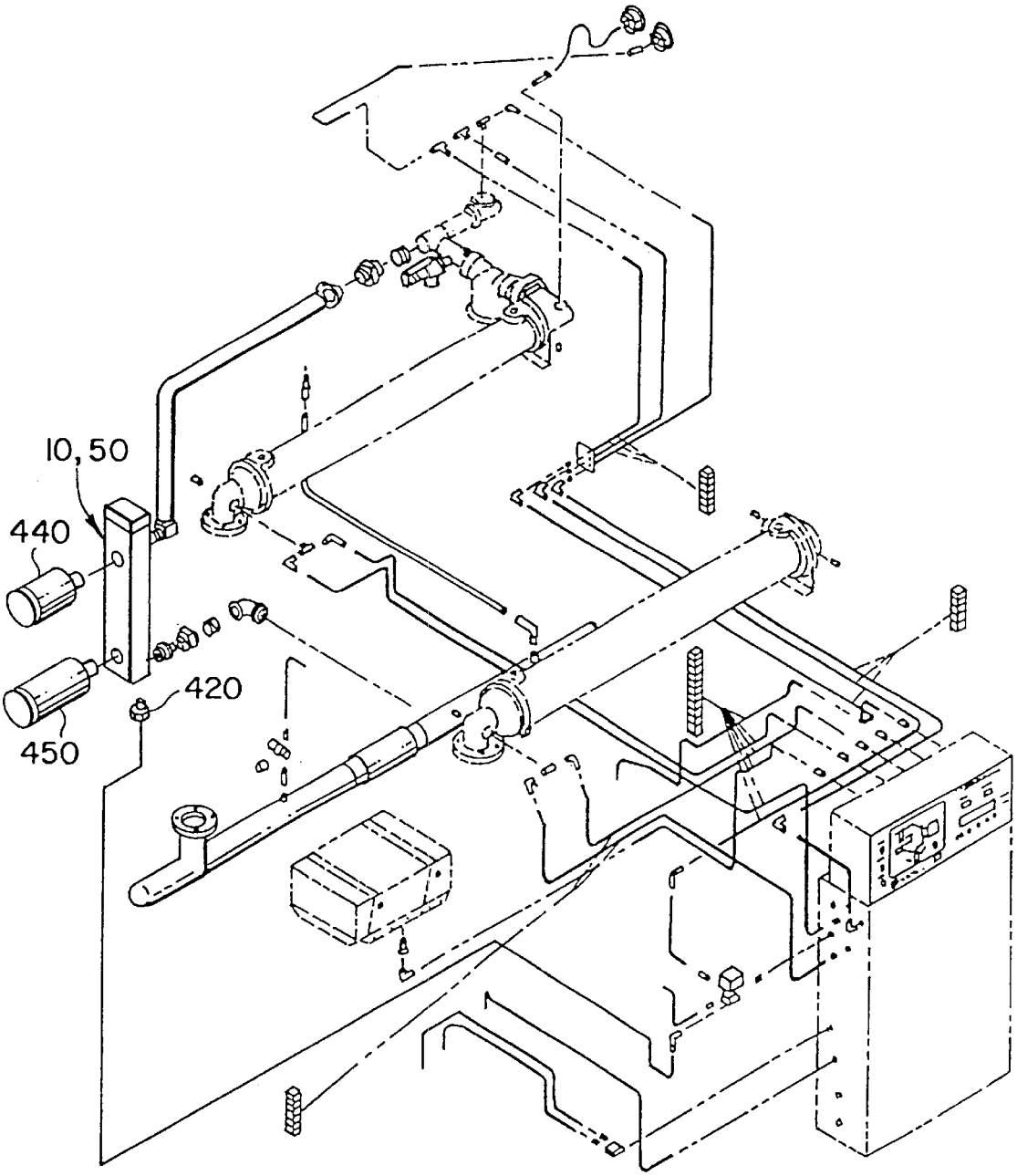
FIG. 5 is a partial exploded view of the improved operative connections of a compressor system of FIG. 4 used with the multistage blowdown valve of FIGS. 1A and 1B.

FIGS. 4 and 5 show the multistage blowdown valve used with a dual stage compressor system 1002. The dual stage compressor system 1002 described herein is best described in U.S. patent application Ser. No. 09/179,523. The multistage blowdown valve 10 can have many applications and be used with many compressor systems. Thus, it should be understood that the compressor system 1002 described herein is merely given as an example and not meant to be limiting.

The operation of compressor system 1002 will now be briefly described. Referring to FIG. 4, the first-stage compressor 102 compresses the air to approximately thirty (30) psi. The compressed air is transmitted from the first stage compressor 102 into the innerstage piping 104. The compressed air flows through the piping 104 to an innerstage cooler 106. The cooler 106 drops the air temperature by approximately three hundred degrees Fahrenheit (300° F.). The cooler 106 is connected to the discharge of the first stage compressor 102 via a coupling plate 108.

The compressed air is transmitted through the innerstage cooler 106 into another innerstage pipe 112. The pipe 112 is connected to a moisture trap 110 via coupling plates 108A. The moisture trap 110 is connected to the innerstage piping that leads to the second stage compressor 114 via innerstage pipe 116, which is also connected to the moistures 110 via coupling plates 108B.

This compressed air is transmitted into the inlet of the second stage compressor 114. The second stage compressor 114 compresses the air approximately another seventy (70) psi, which brings the air up to approximately one hundred (100) psi. The compressed air is transmitted from the second stage compressor 114 into the second stage compressor discharge pipe 118. The pipe 118 is connected to another discharge pipe 118A leading to a compressor package discharge cooler 120. The cooler 120 again drops the temperature of the compressed air transmitted therethrough by approximately three hundred degrees Fahrenheit (300° F.).

Innerstage pipe 116 has a bung 150 welded thereto, which connects the innerstage pipe 116 to the inlet port 26 of the multistage blowdown valve 10. The connection to inlet port 26 is through a pipe elbow 151, pipe nipple 152, pipe coupling 153, and pipe nipple 154. A muffler 450 is attached to the discharge port 28 of the blowdown valve 10. The purpose of the muffler 450 is to reduce the amount of noise that would be created when any trapped air pressure is vented to atmosphere.

Discharge pipe 130B is attached to the moisture trap 126, has a T shaped bung 170A welded thereto, and has a package temperature probe 2010 is located within it. One end of the T-shaped bung 170A has one end of a pipe elbow 128A coupled thereto. The other end of the pipe elbow 128A is coupled to the discharge pipe 130A. A pipe nipple 171 is connected to the other end of the bung 170A, which is threaded onto a coupling 172, which is connected to pipe nipple 173. The inlet port 30 of the multistage blowdown valve 10 is connected to the pipe nipple 173. The discharge port 32 of valve 10 has an exhaust muffler 440 operatively connected thereto. The muffler 440 reduces the amount of noise created when any trapped air pressure is vented to atmosphere.

The multistage blowdown valve 10 of the present invention will exhaust any trapped pressure at shutdown or unload of the two stage compressor 1002 that might be trapped in innerstage pipe 116 and in the discharge piping 130B from the second stage compressor 114. Due to the integration of the interstage and second stage blowdown valves, the interstage and the second stage will be decompressed simultaneously. Therefore, if the second stage blowdown valve malfunctions and fails to open, the innerstage blowdown valve will remain open thus averting possible compressor failure.

Additional modifications need to be made to the compressor system 1002 to use it with the multistage blowdown valve 10 of the present invention. Tubing elbow 180, which was attached to the moisture trap 126, is now attached to a shuttle check valve 492. One side of the shuttle check valve 492 is connected to the moisture trap 126 through a pipe fitting 494. The other side of the shuttle check valve 492 is connected to a tubing elbow 490 which is connected to tubing 488. Tubing 488 has an elbow 480 connected to its other end which is connected to a first end of tubing T 460. Previously, tube fitting 190 was operatively connected to check valve 128A, but is now connected to a second end of tubing T 460. The third end of tubing T 460 is connected through a pipe fitting 470 to check valve 128A.

The dual blowdown valve 10, 50 of the present invention lowers the pressure ratio across the second stage, i.e., the value of the pressure across the second stage minus the pressure across the interstage, divided by the value of the pressure across the interstage. Through testing, it has been determined that using the dual blowdown valve of the present invention can lower the second stage pressure ratio under normal operating conditions from a value above six to a value below three.

One of the benefits of maintaining a low-pressure ratio across the second stage compressor during normal operations is that it lowers operating temperatures in the second stage compressor. Tests of the dual blowdown concept have shown that a standard blowdown system had a second stage compressor discharge as high as 360 degrees F. during normal cycling operation. Under the same cycling operation, the dual blowdown system had a maximum second stage compressor discharge temperature of 295 degrees F. In this test, the dual blowdown system ran 22 percent cooler than the standard system. These cooler operating temperatures obtained from using the dual blowdown valve 10, 50 can lead to a longer compressor lifespan.

It should be understood that the foregoing is illustrative and not limiting and that obvious modifications may be made by those skilled in the art without departing from the spirit of the invention. Accordingly, reference should be made primarily to the accompanying claims, rather than the foregoing specification, to determine the scope of the invention.

What is claimed is:

1. A valve comprising:

a bore;

a first inlet port and a first discharge port;

a second inlet port and a second discharge port;

a means for connecting each inlet port in fluid communication with its respective discharge port; and wherein each means for connecting each inlet port in fluid communication with its respective discharge port is in mechanical communication through said bore with each other means for connecting each inlet port in fluid communication with its respective discharge port.

2. The valve of claim 1, wherein the means for connecting each inlet port in fluid communication with its respective discharge port, being controlled by a single control signal.

3. The valve of claim 2, wherein the control signal comprises pneumatic pressure.

4. The valve of claim 1, wherein the means for connecting each inlet port in fluid communication with its respective discharge port, comprise a plurality of spools located within the bore;

wherein the spools have a first position corresponding to the first inlet port being fluidly isolated from the first discharge port and the second inlet port being fluidly isolated from the second discharge port; and wherein the spools have a second position wherein the first inlet port is in fluid communication with the first discharge port and the second inlet port is in fluid communication with the second discharge port.

5. The valve of claim 4, wherein the means for connecting each inlet port in fluid communication with its respective discharge port, further comprise a spring means for biasing the plurality of spools and a means for receiving a control signal.

6. The valve of claim 1 further comprising at least one additional inlet port and an additional number of discharge ports corresponding to the number of additional inlet ports.

7. A valve comprising:

a first inlet port;

a second inlet port;

one discharge port;

a means for connecting said first inlet port in fluid communication with said discharge port; and a means for connecting said second inlet port in fluid communication with said discharge port;

wherein the means for connecting the first inlet port with the discharge port is in mechanical communication through with the means for connecting the second inlet port with the discharge port.

wherein the valve comprises a first position and a second position;

wherein the first inlet port and the second inlet port are fluidly isolated from the discharge port and each other when the valve is in the first position; and wherein the first inlet port and the second inlet port are in fluid communication with the discharge port when the valve is in the second position.

8. The valve of claim 7, wherein the valve further comprises:

a bore; and at least one spool located within the bore wherein said first position comprises a position wherein the alignment of the at least one spool and the inlet and discharge ports are such that the ports are fluidly isolated from with one another; and wherein said second position comprises a position wherein the alignment of the at least one spool and the inlet and discharge ports are such that all three ports are fluidly connected to one another.

9. The valve of claim 7 further comprising additional inlet and discharge ports wherein the number of inlet ports and the number of discharge ports are not equal.

10. A valve comprising:

a first inlet port and a first discharge port;

a second inlet port and a second discharge port wherein the second inlet and discharge ports are fluidly isolated from the first inlet and discharge ports;

a means for being controlled by a single control signal; and a means for connecting the first inlet port in fluid communication with the first discharge port simultaneously with connecting the second inlet port in fluid communication with the second discharge port.

11. The valve of claim 10, wherein the means for simultaneously connecting each inlet port with its respective discharge port comprises a plurality of spools located within a bore.

12. The valve of claim 10, wherein the means for simultaneously connecting each inlet port with its respective discharge port comprises:

a first position wherein the first inlet port is fluidly isolated from the first discharge port and the second inlet port is fluidly isolated from the second discharge port; and a second position wherein the first inlet port is in fluid communication with the first discharge port and the second inlet port is in fluid communication with the second discharge port.

13. The valve of claim 10, wherein the first inlet port and the first discharge port are fluidly isolated from both the second inlet port and the second discharge port.

14. A blowdown valve for regulating pressure in a compressor system comprising a first compressor, innerstage, second compressor and a second stage, the valve comprising;

a first inlet port and a first discharge port; and a second inlet port and a second discharge port;

wherein the first inlet port is effectively coupled to the innerstage and the second inlet port is effectively coupled to the second stage;

wherein the valve has a first position wherein the first inlet port and the first discharge port are fluidly isolated and the second inlet port and the second discharge port are fluidly isolated;

wherein the valve has a second position wherein the first inlet port and the first discharge port are in fluid communication and the second inlet port and the second discharge port are in fluid communication.

15. The blowdown valve of claim 14, wherein the compressor system further comprises at least one additional innerstage and at least one additional compressor and the valve further comprises at least one more set of inlet and discharge ports, such that each additional set of ports is fluidly isolated when the valve is in the first position and each additional set of ports is in fluid communication when the valve is in the second position, wherein the each set of inlet and discharge ports are fluidly isolated from the remaining sets of inlet and discharge ports.

* * * * *